US011828109B2

(12) United States Patent
Bomidi et al.

(10) Patent No.: US 11,828,109 B2
(45) Date of Patent: Nov. 28, 2023

(54) CUTTING ELEMENTS FOR EARTH-BORING TOOLS AND RELATED EARTH-BORING TOOLS AND METHODS

(71) Applicant: Baker Hughes Oilfield Operations LLC, Houston, TX (US)

(72) Inventors: John A. Bomidi, Spring, TX (US); Konrad T. Izbinski, The Woodlands, TX (US); Jayesh Jain, The Woodlands, TX (US); Xu Huang, Spring, TX (US); Marc Bird, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 15 days.

(21) Appl. No.: 17/340,964

(22) Filed: Jun. 7, 2021

(65) Prior Publication Data

US 2022/0389768 A1 Dec. 8, 2022

(51) Int. Cl.
*E21B 10/567* (2006.01)

(52) U.S. Cl.
CPC ..... *E21B 10/5676* (2013.01); *E21B 10/567* (2013.01); *E21B 2200/20* (2020.05)

(58) Field of Classification Search
CPC ..... E21B 10/42; E21B 10/43; E21B 10/55; E21B 10/567; E21B 10/5671; E21B 10/5673; E21B 10/5676; E21B 10/62; E21B 10/627; E21B 10/633
See application file for complete search history.

(56) References Cited

U.S. PATENT DOCUMENTS

| | | | | |
|---|---|---|---|---|
| 4,109,737 | A | 8/1978 | Bovenkerk | |
| 5,437,343 | A | 8/1995 | Cooley et al. | |
| 6,059,054 | A * | 5/2000 | Portwood | E21B 10/16 175/430 |
| 6,196,340 | B1 | 3/2001 | Ensen et al. | |
| 6,935,444 | B2 * | 8/2005 | Lund | E21B 10/567 175/426 |
| 7,743,855 | B2 * | 6/2010 | Moss | E21B 10/52 175/426 |
| 9,598,909 | B2 | 3/2017 | Patel | |
| 9,650,837 | B2 | 5/2017 | Patel et al. | |
| 10,000,975 | B2 * | 6/2018 | Jiang | E21B 10/567 |
| 10,378,289 | B2 | 8/2019 | Stockey | |
| 10,480,253 | B2 * | 11/2019 | Vempati | E21B 10/567 |
| 10,570,668 | B2 | 2/2020 | Izbinski et al. | |

(Continued)

FOREIGN PATENT DOCUMENTS

| | | | | |
|---|---|---|---|---|
| GB | 2300437 A * | 11/1996 | | E21B 10/5673 |

OTHER PUBLICATIONS

KC Bits, PDC Cutters, Mar. 21, 2019, accessed via the Internet Archives Wayback Machine (Year: 2019).*

(Continued)

*Primary Examiner* — Blake Michener
(74) *Attorney, Agent, or Firm* — TraskBritt

(57) ABSTRACT

Cutting elements for earth-boring tools may include a cutting edge located proximate to a periphery of the cutting element. The cutting edge may be positioned and configured to contact an earth formation during an earth-boring operation. The cutting edge may include a first portion having a first radius of curvature and a second portion having a second, larger radius of curvature. The second portion may be circumferentially offset from the first portion.

19 Claims, 8 Drawing Sheets

(56) References Cited

U.S. PATENT DOCUMENTS

| | | | | |
|---|---|---|---|---|
| 2005/0247492 | A1* | 11/2005 | Shen | E21B 10/5673 175/426 |
| 2007/0131458 | A1* | 6/2007 | Shen | E21B 10/5673 175/426 |
| 2008/0156544 | A1* | 7/2008 | Singh | E21B 10/16 175/426 |
| 2008/0292415 | A1* | 11/2008 | Kuroda | B23B 27/145 83/53 |
| 2008/0296070 | A1* | 12/2008 | Shen | E21B 10/5673 76/108.4 |
| 2010/0059287 | A1* | 3/2010 | Durairajan | E21B 10/5673 175/420.2 |
| 2011/0303466 | A1* | 12/2011 | DiGiovanni | E21B 10/5673 175/428 |
| 2013/0306377 | A1 | 11/2013 | Digiovanni et al. | |
| 2014/0246242 | A1* | 9/2014 | Radford | E21B 10/54 175/263 |
| 2015/0259988 | A1* | 9/2015 | Chen | E21B 10/5735 175/430 |
| 2017/0175452 | A1* | 6/2017 | Vempati | E21B 10/567 |
| 2018/0320450 | A1 | 11/2018 | Borge | |
| 2019/0071933 | A1* | 3/2019 | Gan | E21B 10/5676 |
| 2020/0032588 | A1* | 1/2020 | Izbinski | E21B 10/5735 |

OTHER PUBLICATIONS

Dictionary definition of "convex", accessed via thefreedictionary.com on Dec. 22, 2022.*

* cited by examiner

CUTTING ELEMENTS FOR EARTH-BORING TOOLS AND RELATED EARTH-BORING TOOLS AND METHODS

FIELD

This disclosure relates generally to cutting elements for earth-boring tools and related earth-boring tools and methods. More specifically, disclosed embodiments relate to cutting elements for earth-boring tools having geometries that may increase useful life, reduce peak stresses induced in the cutting elements, and reduce the risk of crack initiation, crack propagation, and spalling when compared to conventional geometries for cutting elements.

BACKGROUND

Earth-boring tools for forming wellbores in subterranean earth formations may include cutting elements secured to a body. For example, fixed-cutter earth-boring rotary drill bits (also referred to as "drag bits") include cutting elements fixedly attached to a bit body of the drill bit. Similarly, roller cone earth-boring rotary drill bits may include cones mounted on bearing pins extending from legs of a bit body, such that each cone is capable of rotating about the bearing pin on which it is mounted. Cutting elements may be mounted to each cone of the drill bit. Rotation of the bit body while applying weight to the drill bit in either such embodiment may cause the cutting elements to contact, penetrate, and remove material from an earth formation.

The cutting elements used in such earth-boring tools often include polycrystalline diamond compact (often referred to as "PDC") cutting elements, also termed "cutters." These cutting elements conventionally include a polycrystalline diamond (PCD) material, which may be characterized as a superabrasive or superhard material. Such polycrystalline diamond materials are formed by sintering and bonding together relatively small synthetic, natural, or a combination of synthetic and natural diamond grains or crystals, termed "grit." Sintering occurs under conditions of high temperature and high pressure in the presence of a catalyst, such as, for example, cobalt, iron, nickel, or alloys and mixtures thereof, to form a layer of polycrystalline diamond material, also called a "diamond table." These processes are often referred to as high temperature/high pressure ("HTHP") processes.

The cutting element substrate may include a ceramic-metal composite material (a "cermet"), such as, for example, cobalt-cemented tungsten carbide. In some instances, the polycrystalline diamond table may be formed on the cutting element, for example, during the HTHP sintering process. In such instances, cobalt or other catalyst material in the cutting element substrate may be swept into the diamond grains or crystals during sintering and serve as a catalyst material for forming a diamond table from the diamond grains or crystals. Powdered catalyst material may also be mixed with the diamond grains or crystals prior to sintering the grains or crystals together in an HTHP process. In other methods, however, the diamond table may be formed separately from the cutting element substrate and subsequently attached thereto.

BRIEF SUMMARY

In some embodiments, cutting elements for earth-boring tools may include a cutting edge located proximate to a periphery of the cutting element. The cutting edge may be positioned and configured to contact an earth formation during an earth-boring operation. The cutting edge may include a first portion having a first radius of curvature and a second portion having a second, larger radius of curvature. The second portion may be circumferentially offset from the first portion.

In other embodiments, earth-boring tools may include cutting elements affixed to a body. At least one of the cutting elements may include a polycrystalline, superabrasive material secured to an end of a substrate. The polycrystalline, superabrasive material may include a cutting edge located proximate to a periphery of the polycrystalline, suprabrasive material, the cutting edge located distal from the substrate. The cutting edge may include a first portion having a first radius of curvature and a second portion having a second, larger radius of curvature. The first portion may be positioned to directly contact and remove an earth formation during use. The second portion may be positioned not to make direct contact with the earth formation during use.

In other embodiments, methods of making cutting elements for earth-boring tools may involve forming a first portion of a cutting edge of the cutting element to have a first radius of curvature. The cutting edge may be located proximate to a periphery of the cutting element, the cutting edge positioned and configured to contact an earth formation during an earth-boring operation. A second portion of the cutting edge may be formed to have a second, larger radius of curvature, the second portion circumferentially offset from the first portion.

BRIEF DESCRIPTION OF THE DRAWINGS

While this disclosure concludes with claims particularly pointing out and distinctly claiming specific embodiments, various features and advantages of embodiments within the scope of this disclosure may be more readily ascertained from the following description when read in conjunction with the accompanying drawings. In the drawings:

DETAILED DESCRIPTION

Figure 1:
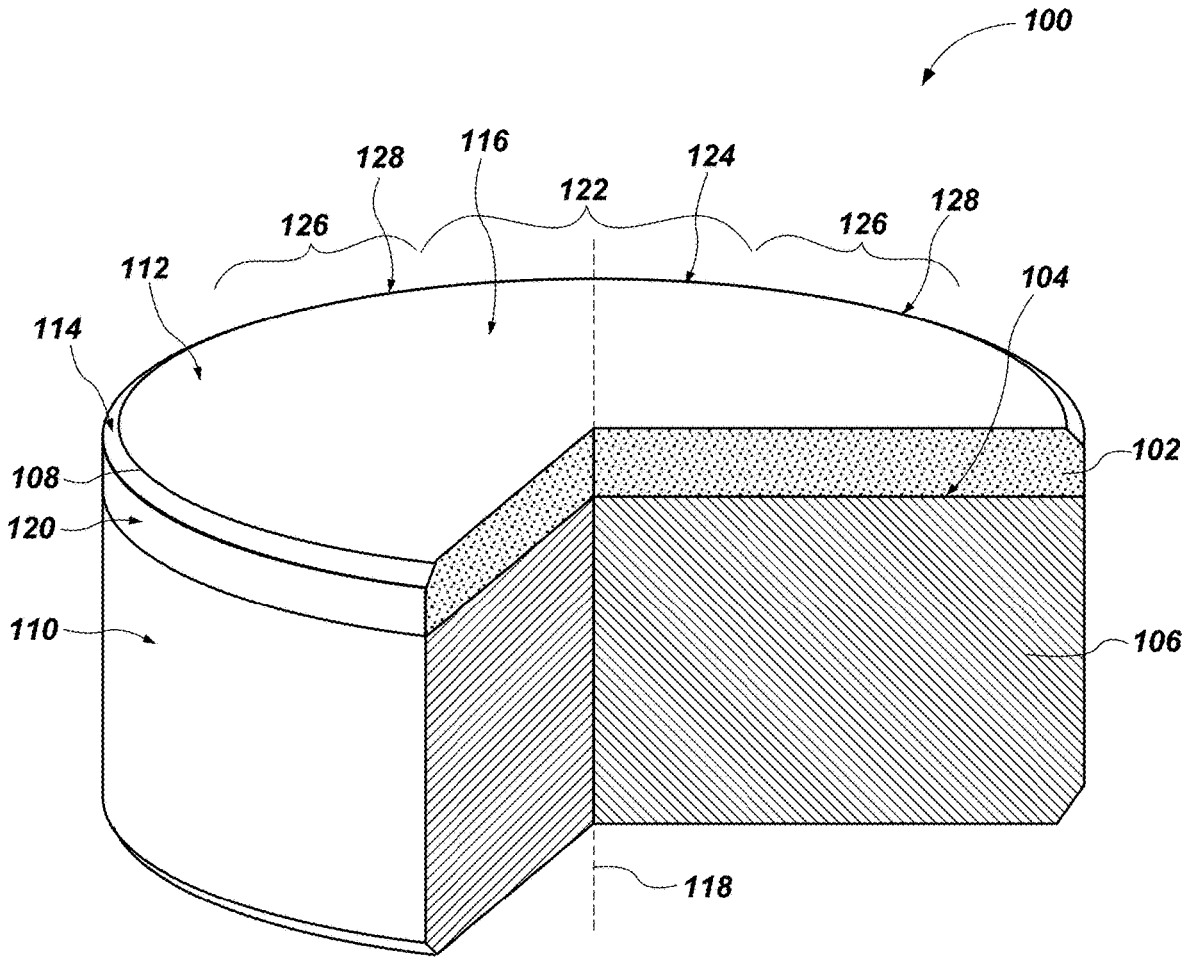
FIG. 1 is a partial cutaway perspective side view of a cutting element for an earth-boring tool in accordance with this disclosure.

The illustrations presented in this disclosure are not meant to be actual views of any particular cutting element, earth-boring tool, or component thereof, but are merely idealized representations employed to describe illustrative embodiments. Thus, the drawings are not necessarily to scale.

Disclosed embodiments relate generally to cutting elements for earth-boring tools having geometries that may increase useful life, reduce peak stresses induced in the cutting elements, and reduce the risk of crack initiation, crack propagation, and spalling when compared to conventional geometries for cutting elements. More specifically, disclosed are embodiments of cutting elements including cutting edges which may be sharp in locations where direct contact is made with an earth formation and which may be rounded in locations circumferentially offset from the sharp portions.

For example, a cutting edge defined at an intersection between a cutting face and a chamfer surface, a side surface, or some other adjacent surface of the cutting element may include a first portion intended to be oriented for direct contact with an earth formation during an earth-boring operation. The first portion may be sharp to facilitate removal of the material of the earth formation, particularly when performing aggressive cutting (e.g., high depth of cut, high rate of penetration, high depth of cut and high rate of penetration). The cutting edge may also include a second portion intended to be circumferentially spaced from direct contact with the earth formation during an earth-boring operation. The second portion may be rounded (e.g., may be less sharp than the first portion) to mitigate stress concentrations that may otherwise be induced in the cutting edge.

In some embodiments, the cutting edge may define multiple instances of the first portion, the second portion, or both. For example, the cutting edge may include two or more sharp first portions, enabling the cutting element to be repositioned to present a fresh, sharp first portion when another first portion has become dulled through use. As another example, the cutting edge may include two or more rounded second portions to mitigate stress concentrations in multiple locations around the perimeter of the cutting edge. In some embodiments, the cutting edge may include a second portion interposed between each first portion, and a given pair of second portions may flank each respective first portion.

In some embodiments, cutting elements including the sharp first portion(s) and the rounded second portion(s) may include one or more chamfer surfaces. For example, the cutting edge may be located at an intersection between a chamfer surface and a cutting face of a cutting element. In some such embodiments, another chamfer surface may extend from the first chamfer surface toward a periphery of the cutting element. A transition edge located between the two chamfer surfaces may be, for example, rounded. More specifically, a radius of curvature of the transition edge may be greater than that of the sharp first portion of the cutting edge, such as, for example, equal to that of the rounded second portion of the cutting edge.

The term "radius of curvature," as applied to cutting edges of cutting elements in this disclosure, means and includes the radius of curvature as measured about a respective axis extending perpendicular to a cross-sectional side view of a given cutting element. For example, the radius of curvature of a cutting edge may represent a measure of how sharp or rounded (e.g., dull) the cutting edge of a cutting element may be. By way of contrast, the term "radius of curvature," as used in connection with cutting edges of cutting elements herein, does not refer to the radius of curvature as measured about a central geometric axis of the cutting element.

As used herein, the terms "substantially" and "about" in reference to a given parameter, property, or condition means and includes to a degree that one of ordinary skill in the art would understand that the given parameter, property, or condition is met with a degree of variance, such as within acceptable manufacturing tolerances. For example, a parameter that is substantially or about a specified value may be at least about 90% the specified value, at least about 95% the specified value, at least about 99% the specified value, or even at least about 99.9% the specified value.

As used herein, the term "earth-boring tool" means and includes any type of bit or tool used for drilling during the formation or enlargement of a wellbore in a subterranean formation. For example, earth-boring tools include fixed-cutter bits, roller cone bits, percussion bits, core bits, eccentric bits, bicenter bits, reamers, mills, drag bits, hybrid bits (e.g., bits including rolling components in combination with fixed cutting elements), and other drilling bits and tools known in the art.

As used herein, the term "superabrasive material" means and includes any material having a Knoop hardness value of about 3,000 Kgf/mm$^2$ (29,420 MPa) or more. Superabrasive materials include, for example, diamond and cubic boron nitride. Superabrasive materials may also be referred to as "superhard" materials.

As used herein, the term "polycrystalline material" means and includes any structure comprising a plurality of grains (i.e., crystals) of material that are bonded directly together by inter-granular bonds. The crystal structures of the individual grains of the material may be randomly oriented in space within the polycrystalline material.

As used herein, the terms "inter-granular bond" and "interbonded" mean and include any direct atomic bond (e.g., covalent, metallic, etc.) between atoms in adjacent grains of superabrasive material.

As used herein, terms of relative positioning, such as "above," "over," "under," and the like, refer to the orientation and positioning shown in the figures. During real-world formation and use, the structures depicted may take on other orientations (e.g., may be inverted vertically, rotated about any axis, etc.). Accordingly, the descriptions of relative positioning must be reinterpreted in light of such differences in orientation (e.g., resulting in the positioning structures described as being located "above" other structures underneath or to the side of such other structures as a result of reorientation).

The terms "circumference," "circumferential," and "circumferentially," as used herein, are terms of convenience referring to extent to which a feature may extend along a perimeter of a cutting edge of a cutting element. As many cutting elements have cutting edges that are circular in shape, use of such terms naturally applies. However, a feature may be located about a portion of a "circumference," and extend "circumferentially" along a portion, of a cutting edge having a different shape, such as, for example, oval, elliptical, polygonal, etc. In such an embodiment, the terms "circumference" and "circumferentially" refer to the relevant shape and/or distance along the perimeter of the cutting edge.

FIG. 1 is a partial cutaway perspective side view of a cutting element 100 for an earth-boring tool in accordance with this disclosure. The cutting element 100 may include a polycrystalline, superabrasive material 102 secured to an end 104 of a substrate 106, in some embodiments. In other embodiments, the cutting element 100 may include a monolithic mass of material (e.g., a ceramic, a metal, an alloy) or a monolithic composite material (e.g., a ceramic-metallic composite material) suitable for use in the downhole environment. As a specific, nonlimiting, alternative example, the cutting element 100 may include a mass of cobalt-cemented tungsten carbide particle matrix composite material, optionally impregnated with particles of a superabrasive or polycrystalline, superabrasive material, shaped as a cutting element (often termed an "insert") for an earth-boring tool.

The cutting element 100 may include a cutting edge 108 located proximate to a periphery 110 of the cutting element 100. For example, the cutting edge 108 may be positioned and configured to contact an earth formation during an earth-boring operation wherein the cutting element 100 is used to contact and remove material from an underlying earth formation. In the embodiment of FIG. 1, the cutting edge 108 is located at an intersection between a cutting face 112 and a chamfer surface 114 proximate to a leading end 116 of the cutting element 100, and distal from the substrate 106. The cutting face 112 may be configured as, for example, a generally planar surface oriented at least substantially perpendicular to a central geometric axis 118 of the cutting element 100. In some embodiments, the chamfer surface 114 may extend from the cutting edge 108 at the intersection with the cutting face 112 to a lateral side surface 120 of the cutting element 100 defining the periphery 110. In other embodiments, the cutting edge 108 may be located, for example, at an intersection between the cutting face 112 and the lateral side surface 120.

The cutting edge 108 may include a first portion 122 having a first radius of curvature 124. For example, the first portion 122 may extend along, and occupy, a portion of the cutting edge 108 for positioning in direct, cutting contact with an earth formation during an earth-boring operation. More specifically, the first portion 122 may partially form a perimeter of the cutting edge 108, and may not extend around an entirety of the perimeter of the cutting edge 108. As a specific, nonlimiting example, the first portion 122 may extend around, and occupy, about half or less of the perimeter of the cutting edge 108.

The first radius of curvature 124 may be, for example, small, such that the first portion 122 may be sharp. For example, the first radius of curvature 124 of the first portion 122 may be sized, positioned, oriented, and configured to facilitate removal of a material of an underlying earth formation in response to applied weight forcing the first portion 122 toward and at least partially into the earth formation as well as applied force (e.g., rotation of an earth-boring tool) advancing the first portion 122 into the earth formation.

The cutting edge 108 may also include a second portion 126 having a second, larger radius of curvature 128. For example, the second portion 126 may be circumferentially offset from the first portion 122, may extend along, and occupy, another portion of the cutting edge 108, and may be positioned and oriented to remain out of direct, cutting contact with an earth formation during an earth-boring operation. More specifically, the second portion 126 may partially form another region of a perimeter of the cutting edge 108, and may not extend around an entirety of the perimeter of the cutting edge 108. As a specific, nonlimiting example, the second portion 126 may extend around, and occupy, about half or less of the perimeter of the cutting edge 108.

In some embodiments, the second portion 126 may be located directly adjacent to, and may border, the first portion 122. For example, the cutting edge 108 may include two or more instances of the second portion 126, with a pair of second portions 126 flanking the first portion 122 along the perimeter of the cutting edge 108. More specifically, the cutting edge 108 may include, for example, two or more instances of each of the first portion 122 and the second portion 126, and each first portion 122 located circumferentially between a respective pair of the second portions 126. As a specific, nonlimiting example, each first portion 122 may be located circumferentially between a respective pair of the second portions 126, and second portion 126 may be located circumferentially between a respective pair of the first portions 122.

The second, larger radius of curvature 128 may be, for example, larger than the first radius of curvature 124, such that the second portion 126 may be rounded (e.g., less sharp, more dull) in comparison to the first portion 122. For example, the second, larger radius of curvature 128 of the second portion 126 may be sized, positioned, oriented, and configured to mitigate internal stresses and their potential deleterious effects within the cutting element 100 at the cutting edge 108 during an earth-boring operation. More specifically, the second, larger radius of curvature 128 may be positioned, for example, to remain out of direct, penetrating contact with a material of an underlying earth formation during an earth-boring operation. As a specific, nonlimiting example, the second, larger radius of curvature 128 of the second portion 126 of the cutting edge 108 may be sized, positioned, oriented, and configured to mitigate internal stresses, reduce the risk of crack initiation and propagation, and reduce the risk of spalling in locations circumferentially offset from the first portion 122.

In some embodiments, the cutting edge 108 may define at least two instances of the first portion 122 and at least two instances of the second portion 126. For example, an entirety of a circumference of the cutting edge 108 may be occupied by the instances of the first portion 122 and the instances of the second portion 126. In other embodiments, the cutting edge 108 may include other portions having different radii of curvature, in addition to any instances of the first portion 122 having the first radius of curvature 124 and any instances of the second portion 126 having the second, larger radius of curvature 128.

Figure 2:
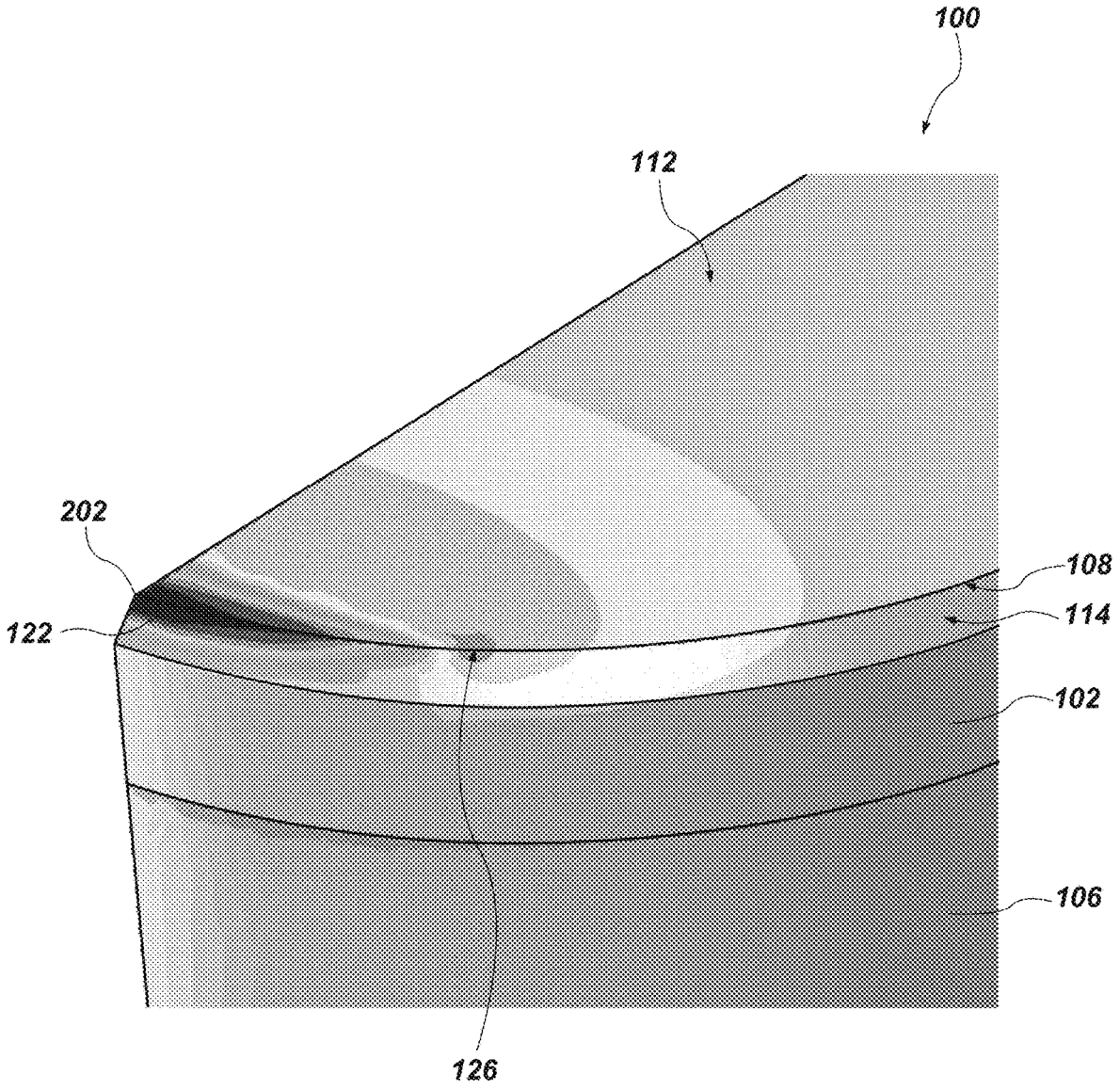
FIG. 2 is a heat-map-style schematic showing results of a simulation of stress induced in the cutting element of FIG. 1 during an earth-boring operation.

FIG. 2 is a heat-map-style schematic showing results of a simulation of stress induced in the cutting element 100 of FIG. 1 during an earth-boring operation. For the sake of simplicity, the cutting element 100 has been bisected by a plane in which the central geometric axis 118 (see FIG. 1) is located, and passing through a cutting point 202 of the cutting element 100. The cutting point 202 is a point on the cutting edge 108 that is positioned and oriented for greatest penetration into an earth formation during an earth-boring operation, and typically comes into contact with material of the earth formation before other portions of the cutting edge 108. The stresses shown are mirrored across the plane containing the central geometric axis 118 (see FIG. 1) and the cutting point 202.

As shown in FIG. 2, maximum stresses in the cutting element 100 are concentrated at and proximate to the cutting point 202 along the perimeter of the cutting edge 108. As distance from the cutting point 202 along the cutting edge 108 increases, the stresses gradually decrease to a local minimum. The cutting point 202 and at least a portion of the region of high stress along the cutting edge 108 proximate to the cutting point 202 may be located within the first portion 122 of the cutting edge 108.

Due to the nonuniform loading of the cutting element 100, the stresses then increase to a local maximum at and near the cutting edge 108 in a location circumferentially offset from the cutting point 202. When the cutting element 100 is used at predetermined depths of cut, predetermined rates of penetration, or both during an earth-boring operation, the second portion 126 may extend across the position on the cutting edge 108 where the local maximum of stress is located. For example, the local maximum of stress may be contained within the second portion 126, and the second portion 126 may extend circumferentially to include at least some region of the cutting edge 108 proximate to the local maximum of stress. Such positioning for the second portion 126 may reduce the magnitude of the local maximum stress, as well as the likelihood that the likelihood that the local maximum of stress may initiate and/or propagate cracks, cause spalling, or otherwise induce damage in the material of the cutting element 100.

Figure 3:
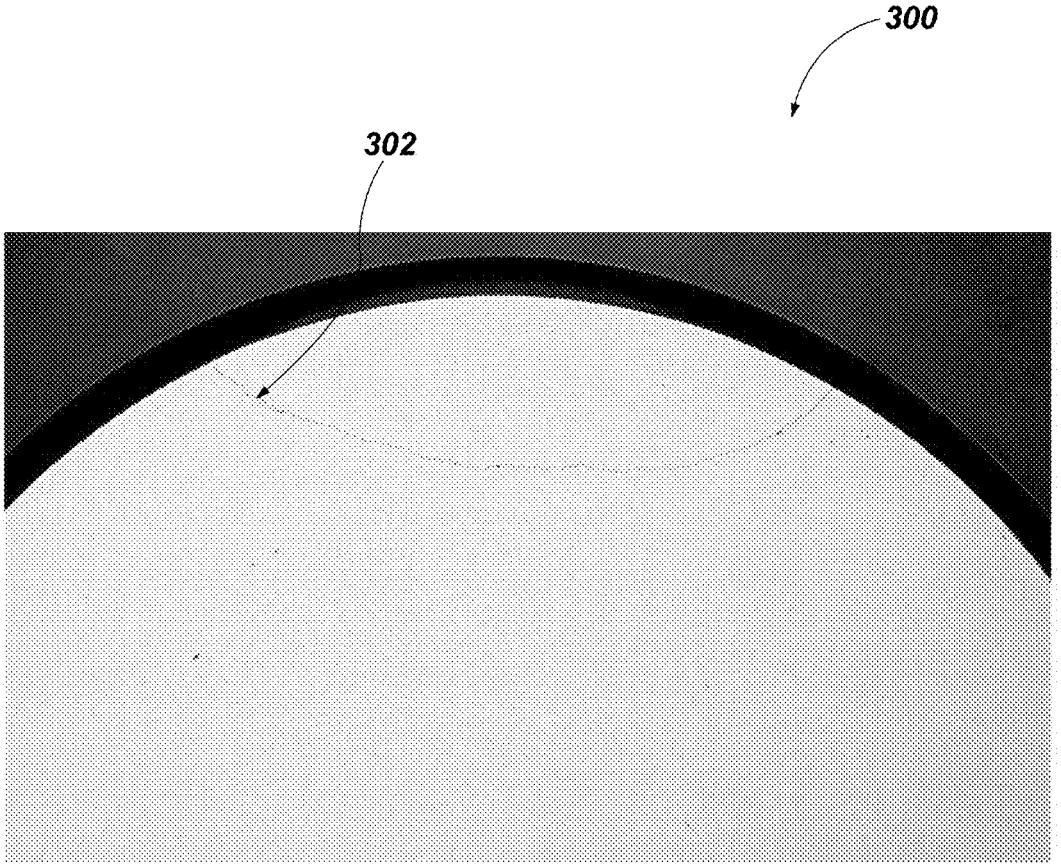
FIG. 3 is a surface view of an image of a cutting element lacking stress-mitigation features, illustrating the position and shape of a crack resulting from stress during an earth-boring operation.

FIG. 3 is a surface view of an image of a cutting element 300 lacking stress-mitigation features, such as the second portion 126 depicted in FIG. 1 and FIG. 2. Specifically, FIG. 3 illustrates the position and shape of a crack 302 in the cutting element 300 resulting from stress during an earth-boring operation. As shown in FIG. 3, the crack 302 did not initiate from the cutting point 202. Rather, the crack 302 initiated from, and/or propagated to, locations circumferentially offset from the cutting point 202. Without the second portions 126 (see FIG. 1 and FIG. 2), the initiation and propagation of a crack 302 at and proximate to the local maximum of stress circumferentially offset from the cutting point 202 may be more likely, as illustrated by the crack 302 in FIG. 3.

Figure 4:
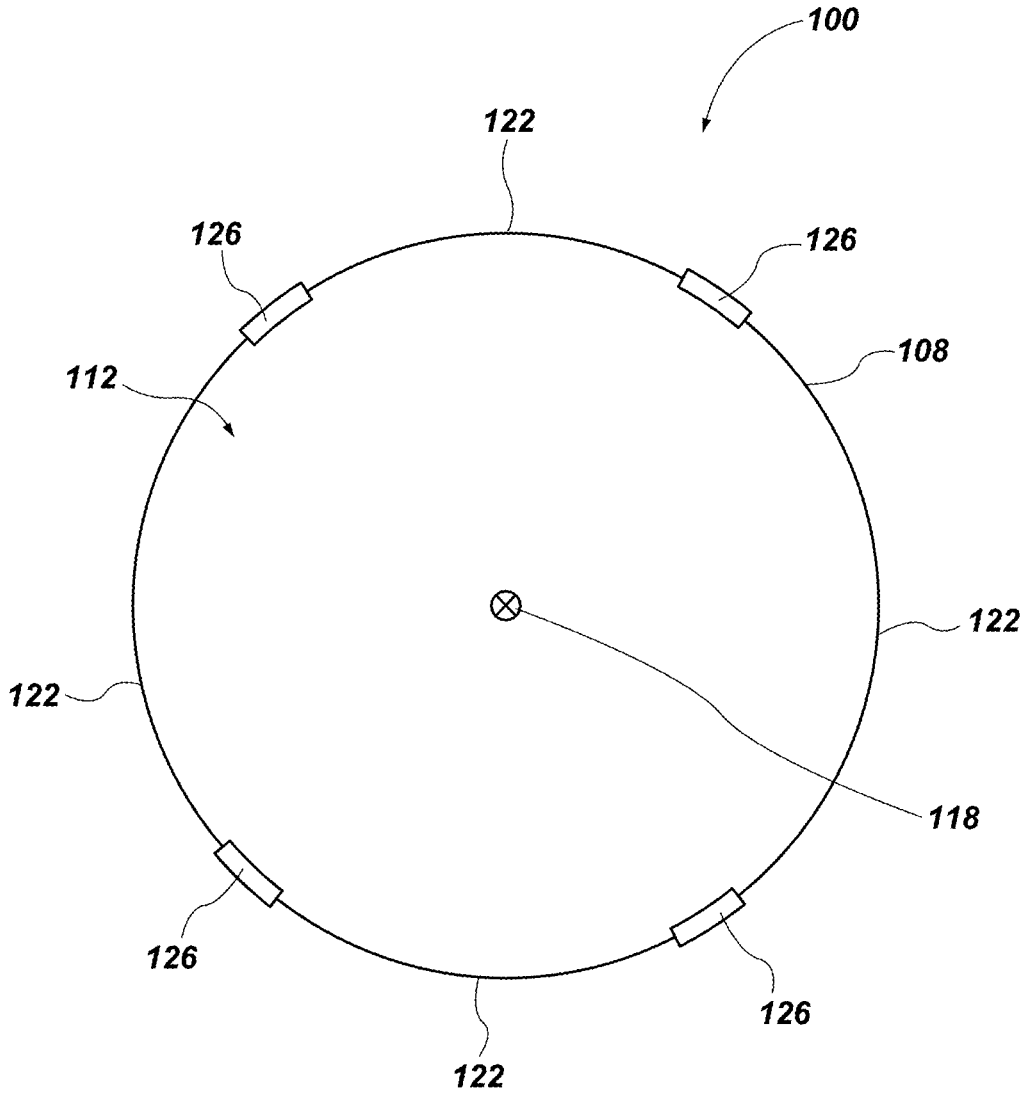
FIG. 4 is a schematic surface view of a cutting face of the cutting element of FIG. 1, illustrating certain features of the cutting element.

FIG. 4 is a schematic surface view of a cutting face of the cutting element 100 of FIG. 1, illustrating certain features of the cutting element 100. In some embodiments, such as that shown in FIG. 4, the cutting edge 108 may include at least two instances of the first portion 122 and at least two instances of the second portion 126. For example, the first portions 122 and the second portions 126 may be distributed about the perimeter of the cutting edge 108, and the first portions 122 and the second portions 126 may be rotationally symmetrical about the central geometric axis 118 of the cutting element 100. More specifically, the first portions 122 and the second portions 126 may be interspersed among one another about the circumference of the cutting edge 108, and the first portions 122 and the second portions 126 may be reflectively symmetrical about at least one plane intersecting the central geometric axis 118 of the cutting element 100.

In some embodiments, the cutting edge 108 may include between one and ten instances of the first portion 122 and between two and ten instances of the second portion 126. For example, the cutting edge 108 may include between two and six instances of the first portion 122 and between two and six instances of the second portion 126. More specifically, the cutting edge 108 may include between two and four instances of the first portion 122 and between two and four instances of the second portion 126. In some embodiments, the number of instances of the first portion 122 may be equal to the number of instances of the second portion 126. In other embodiments, the number of instances of the first portion 122 may be less than the number of instances of the second portion 126. For example, the number of instances of the first portion 122 may be about one-half the number of instances of the second portion 126.

Figure 5:
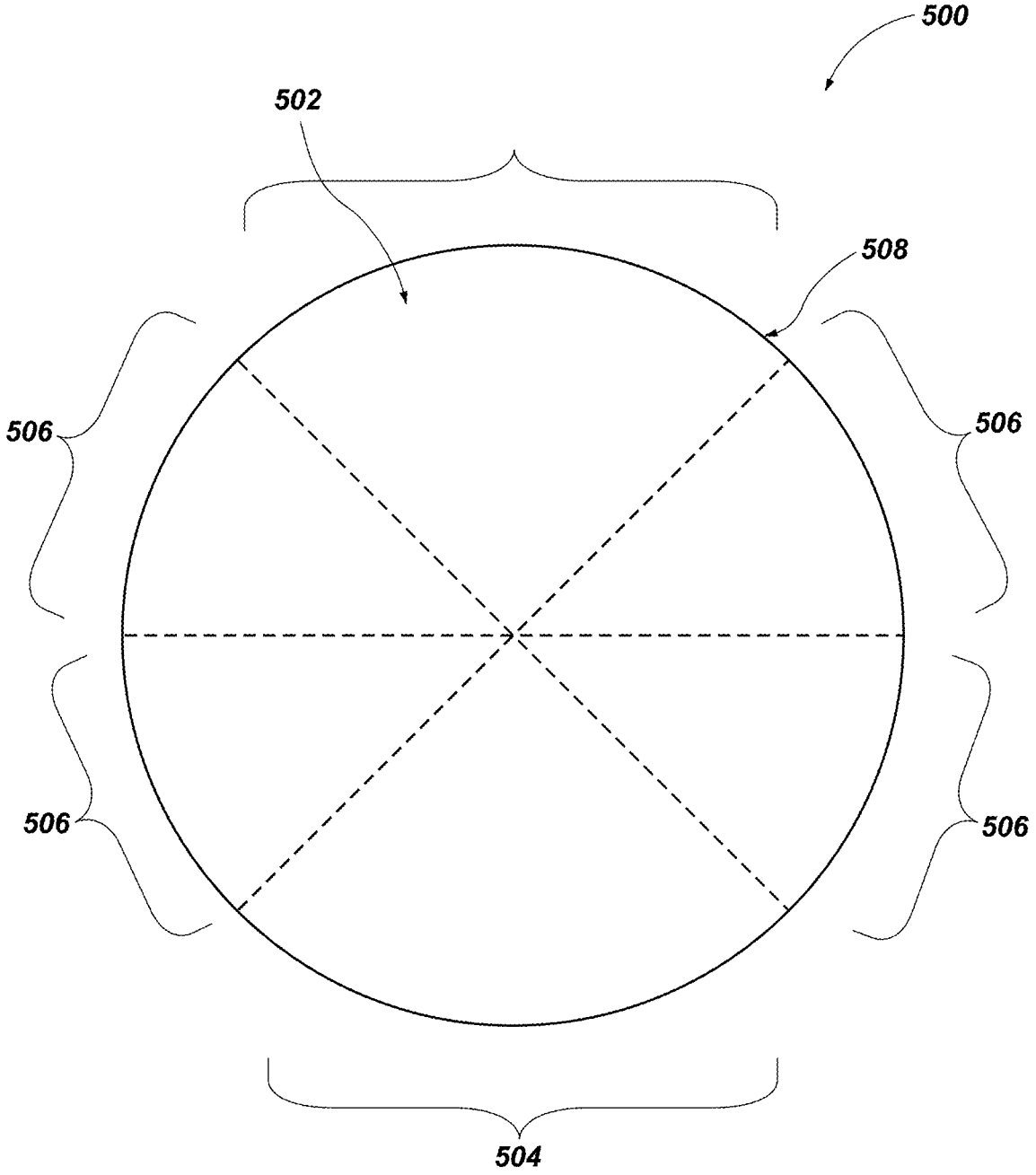
FIG. 5 is another schematic surface view of a cutting face of another embodiment of a cutting element, illustrating certain other features of the cutting element.

FIG. 5 is another schematic surface view of a cutting face 502 of another embodiment of a cutting element 500, illustrating certain other features of the cutting element 500. In some embodiments, the first portion 504 may extend circumferentially for between about 30 degrees and about 88 degrees of the perimeter of the cutting edge 508. For example, a circumferential span of a given instance of the first portion 504 may occupy between about 35 degrees and about 75 degrees of the cutting edge 508. More specifically, the first portion 504 may extend circumferentially along the perimeter of the cutting edge 508 for between about 40 degrees and about 70 degrees. As a specific, nonlimiting example, a given instance of the first portion 504 may have a circumferential span extending for between about 45 degrees and about 65 degrees (e.g., about 50 degrees, about 55 degrees, about 60 degrees) along the cutting edge 508.

A total percentage of the cutting edge 508 occupied by instances of the first portion 504 may be, for example, between about 8% and about 98%. More specifically, the total percentage of the cutting edge 508 occupied by instances of the first portion 504 may be, for example, between about 15% and about 85%. As a specific, nonlimiting example, the total percentage of the cutting edge 508 occupied by instances of the first portion 504 may be, for example, between about 20% and about 75% (e.g., about 25%, about 50%, about 60%).

In some embodiments, the second portion 506 may extend circumferentially for between about 1 degree and about 75 degrees of the perimeter of the cutting edge 508. For example, a circumferential span of a given instance of the second portion 506 may occupy between about 5 degrees and about 70 degrees of the cutting edge 508. More specifically, the second portion 506 may extend circumferentially along the perimeter of the cutting edge 508 for between about 10 degrees and about 60 degrees. As a specific, nonlimiting example, a given instance of the second portion 506 may have a circumferential span extending for between about 15 degrees and about 50 degrees (e.g., about 20 degrees, about 30 degrees, about 45 degrees) along the cutting edge 508.

A total percentage of the cutting edge 508 occupied by instances of the second portion 506 may be, for example, between about 2% and about 92%. More specifically, the total percentage of the cutting edge 508 occupied by instances of the second portion 506 may be, for example, between about 5% and about 75%. As a specific, nonlimiting example, the total percentage of the cutting edge 508 occupied by instances of the second portion 506 may be, for example, between about 10% and about 50% (e.g., about 15%, about 25%, about 40%).

In some embodiments, certain pairs of the second portion 506 may lack an instance of the first portion 504 there between, as shown in FIG. 5. For example, instances of the second portion 506 having different radii of curvature from one another may be located directly adjacent to one another. As another example, a third portion having a third, still larger radius of curvature may be located between a given pair of the second portions 506.

Figure 6:
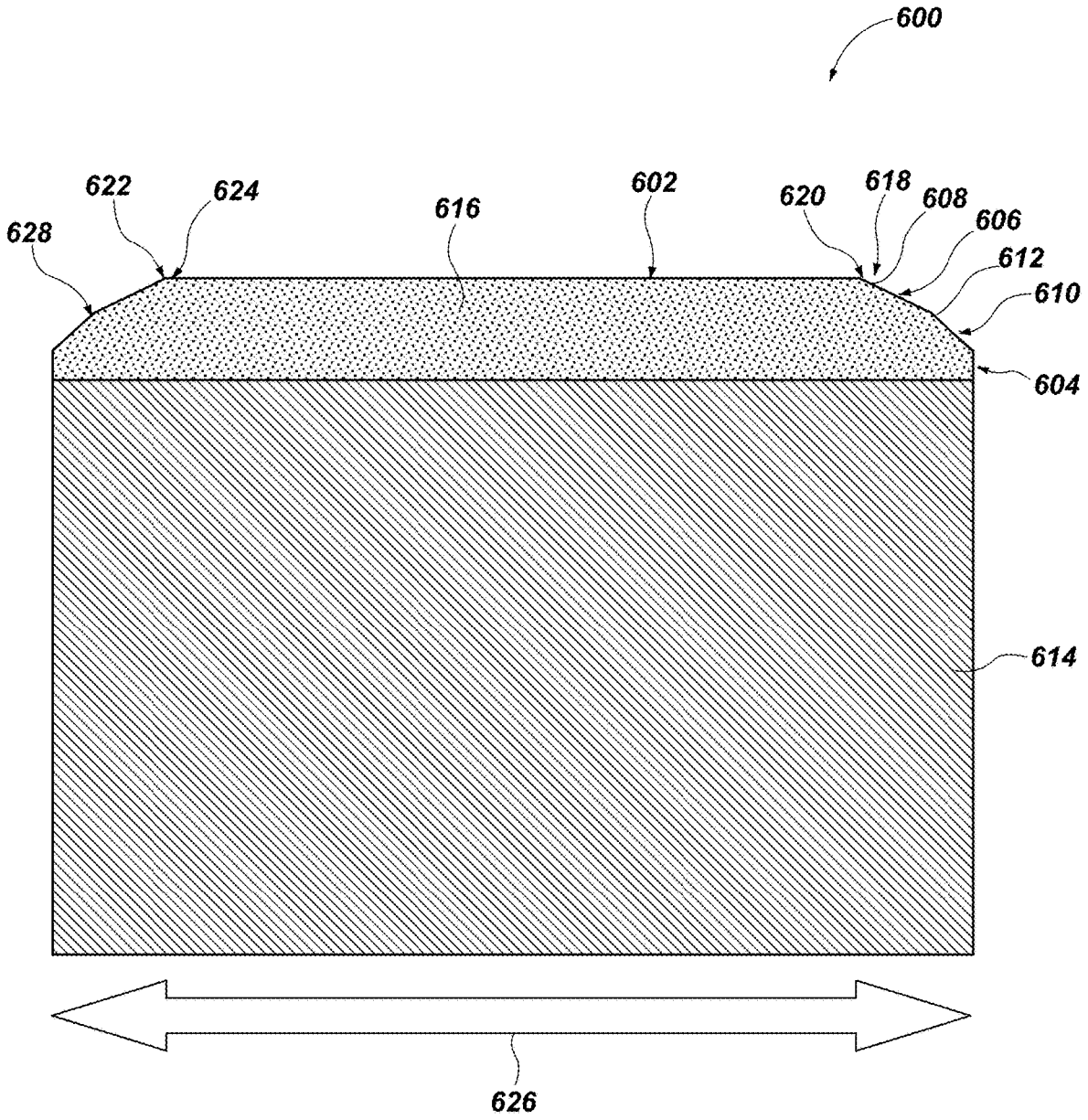
FIG. 6 is a cross-sectional side view of another embodiment of a cutting element in accordance with this disclosure.

FIG. 6 is a cross-sectional side view of another embodiment of a cutting element 600 in accordance with this disclosure. In some embodiments, such as that shown in FIG. 6, the cutting element 600 may include more than one chamfer surface or other gradual transition geometry from the cutting face 602 to the lateral side surface 604. For example, the cutting element 600 may include a first chamfer surface 606 extending from the cutting edge 608 away from the cutting face 602 of the cutting element 600 and a second chamfer surface 610 extending from the first chamfer surface 606 to the periphery of the cutting element 600. A transition edge 612 may be located between the first chamfer surface 606 and the second chamfer surface 610. More specifically, the cutting element 600 may include a first chamfer surface 606 extending radially outward from the cutting edge 608 toward the side surface 604 and axially away from the cutting face 602 of the polycrystalline, superabrasive material 616 and toward the substrate 614.

The second chamfer surface 610 may extend radially outward from the first chamfer surface 606 at the transition edge 612 to the side surface 604 and axially away from the transition edge 612 and toward the substrate 614.

A maximum first radius of curvature 620 of a first portion 618 of the cutting element 600 may be, for example, between about 0.2% and about 3% a maximum diameter 626 of the cutting element 600. More specifically, the maximum first radius of curvature 620 of the first portion 618 may be, for example, between about 0.5% and about 2.5% of the maximum diameter 626 of the cutting element 600. As a specific, nonlimiting example, the maximum first radius of curvature 620 of the first portion 618 may be between about 0.75% and about 2% (e.g., about 1%, about 1.5%) of the maximum diameter 626 of the cutting element 600. In more absolute terms, the maximum first radius of curvature 620 of the first portion 618 may be, for example, between about 0.002 inch (~0.05 mm) and about 0.009 inch (~0.23 mm). More specifically, the maximum first radius of curvature 620 of the first portion 618 may be, for example, between about 0.003 inch (~0.08 mm) and about 0.009 inch (~0.2 mm). As a specific, nonlimiting example, the maximum first radius of curvature 620 of the first portion 618 may be between about 0.004 inch (~0.1 mm) and about 0.007 inch (~0.18 mm) (e.g., about 0.005 inch (~0.13 mm), about 0.006 inch (~0.15 mm)).

A maximum second, larger radius of curvature 624 of a second portion 622 of the cutting element 600 may be, for example, greater than the first radius of curvature 620 and between about 1% and about 15% a maximum diameter 626 of the cutting element 600. More specifically, the maximum second, larger radius of curvature 624 of the second portion 622 may be, for example, between about 2% and about 10% of the maximum diameter 626 of the cutting element 600. As a specific, nonlimiting example, the maximum second, larger radius of curvature 624 of the second portion 622 may be between about 4% and about 8% (e.g., about 5%, about 6%, about 7%) of the maximum diameter 626 of the cutting element 600. In more absolute terms, the maximum second, larger radius of curvature 624 of the second portion 622 may be, for example, between about 0.01 inch (~0.25 mm) and about 0.15 inch (~3.8 mm). More specifically, the maximum second, larger radius of curvature 624 of the second portion 622 may be, for example, between about 0.02 inch (~0.5 mm) and about 0.12 inch (~3 mm). As a specific, nonlimiting example, the maximum second, larger radius of curvature 624 of the second portion 622 may be between about 0.05 inch (~1.3 mm) and about 0.1 inch (~2.5 mm) (e.g., about 0.07 inch (~1.8 mm), about 0.08 inch (~2 mm)).

In embodiments having a transition edge 612, the transition edge 612 may have a third radius of curvature 628 greater than the first radius of curvature 620. For example, the third radius of curvature 628 may be at least substantially equal to, or greater than, the second, larger radius of curvature 624. Unlike the discontinuous first portions 618 and second portions 622 distributed about the perimeter of the cutting edge 608, the third radius of curvature 628 may be at least substantially continuous around a perimeter of the transition edge 612 in at least some embodiments.

Figure 7:
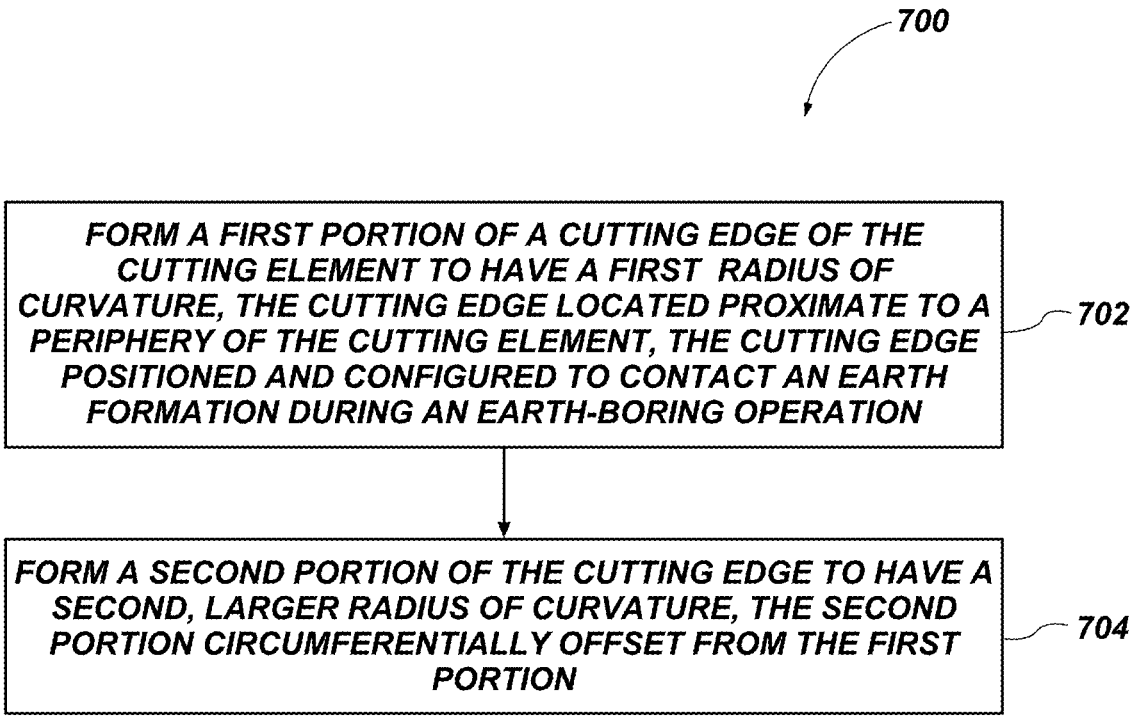
FIG. 7 is a flowchart of a method of making a cutting element in accordance with this disclosure.

FIG. 7 is a flowchart of a method 700 of making a cutting element in accordance with this disclosure. The method 700 may involve, for example, forming a first portion of a cutting edge of a cutting element to have a first radius of curvature, as shown at act 702. The cutting edge may be located proximate to a periphery of the cutting element, and the cutting edge may be positioned and configured to contact an earth formation during an earth-boring operation, as also shown at act 702. The method 700 may further involve forming a second portion of the cutting edge to have a second, larger radius of curvature, the second portion circumferentially offset from the first portion, as shown at act 704.

In some embodiments, formation of the first radius of curvature and the second, larger radius of curvature may take place utilizing subtractive manufacturing processes. For example, forming the first portion and the second portion, and their associated first radius of curvature and second, larger radius of curvature, may involve removing a quantity of a material of the cutting element. More specifically, forming the first portion and the second portion, and their associated first radius of curvature and second, larger radius of curvature, may involve grinding, honing, or laser machining the material of the cutting element. As a specific, nonlimiting example, forming the first portion and the second portion, and their associated first radius of curvature and second, larger radius of curvature, may involve grinding, honing, or laser machining a polycrystalline, superabrasive material of the cutting element. In other embodiments, forming the first portion and the second portion, and their associated first radius of curvature and second, larger radius of curvature, may occur during formation of the material of the cutting element itself. For example, forming the first portion and the second portion, and their associated first radius of curvature and second, larger radius of curvature, may be accomplished utilizing inverse features in a mold utilized to form a polycrystalline, superabrasive material of the cutting element, such as, for example, during an HTHP process.

In some embodiments, selection of the position and circumferential span of the first, second, and any other portions of the cutting edge may be made at least partially utilizing a simulation-based approach. For example, an earth-boring process utilizing a simulated version of the cutting element may be simulated. Simulation may involve, for example, accepting parameters for the design of the cutting element to define the simulated version of the cutting element. Such parameters may include, for example, size, shape, material selection, inclusion of certain features (e.g., chamfers), other parameters, or any combination or subcombination of these. Simulation may also involve accepting parameters for deployment of the cutting element, such as, for example, position of a cutting point on the cutting edge, rake angle, side rake angle, other parameters relevant to how the cutting element would interact with an underlying earth formation, or any combination or subcombination of these. Simulation may further involve accepting drilling parameters, such as, for example, depth of cut, ranges for depth of cut, targeted rate of penetration, ranges for rate of penetration, targeted weight-on-bit, ranges for weight-on-bit, expected formation characteristics, ranges for expected formation characteristics, configuration of the earth-boring tool, location of deployment of the cutting element on the earth-boring tool, other parameters relevant to how a drilling operation utilizing the cutting element would perform, or any combination or subcombination of these. Simulation techniques may include finite element analysis, such as, for example, geometrically nonlinear beam or mass element analysis. In some embodiments, simulation may be iterated to determine ranges for resulting behavior of the cutting element, such as, for example, in response to design changes, variations in earth material, changes to drilling parameters, and other variables.

A position on a simulated cutting edge of the simulated version of the cutting element where a local maximum of stress is located may be determined in response to simulating the earth-boring process. In some embodiments, multiple positions multiple locations on the simulated cutting edge where local maxima of stress offset from the cutting point may be located may be identifiable through simulation. For example, ranges for the expected location of the local maximum of stress offset from the cutting point based on expected variations in the input parameters may be identified in response to iterative simulation. As another example, a circumferential span of a local maximum of stress offset from the cutting point, within a predetermined range of an absolute local maximum stress offset from the cutting point, may be identified in response to simulation.

A first position and a first angular distance on the cutting edge to be occupied by the first portion may be selected in response to determining the position on the simulated cutting edge where the local maximum of stress is located. For example, the first portion may include, and extend circumferentially outward from, the cutting point and may occupy a portion of the cutting edge proximate to the cutting point.

A second, different position and a second angular distance on the cutting edge to be occupied by the second portion may be selected in response to determining the position on the simulated cutting edge where the local maximum of stress is located. For example, the second portion may include, and extend circumferentially outward from, the location or range of locations where the local maximum of stress offset from the cutting point is located, and may occupy a portion of the cutting edge offset from the cutting point.

Figure 8:
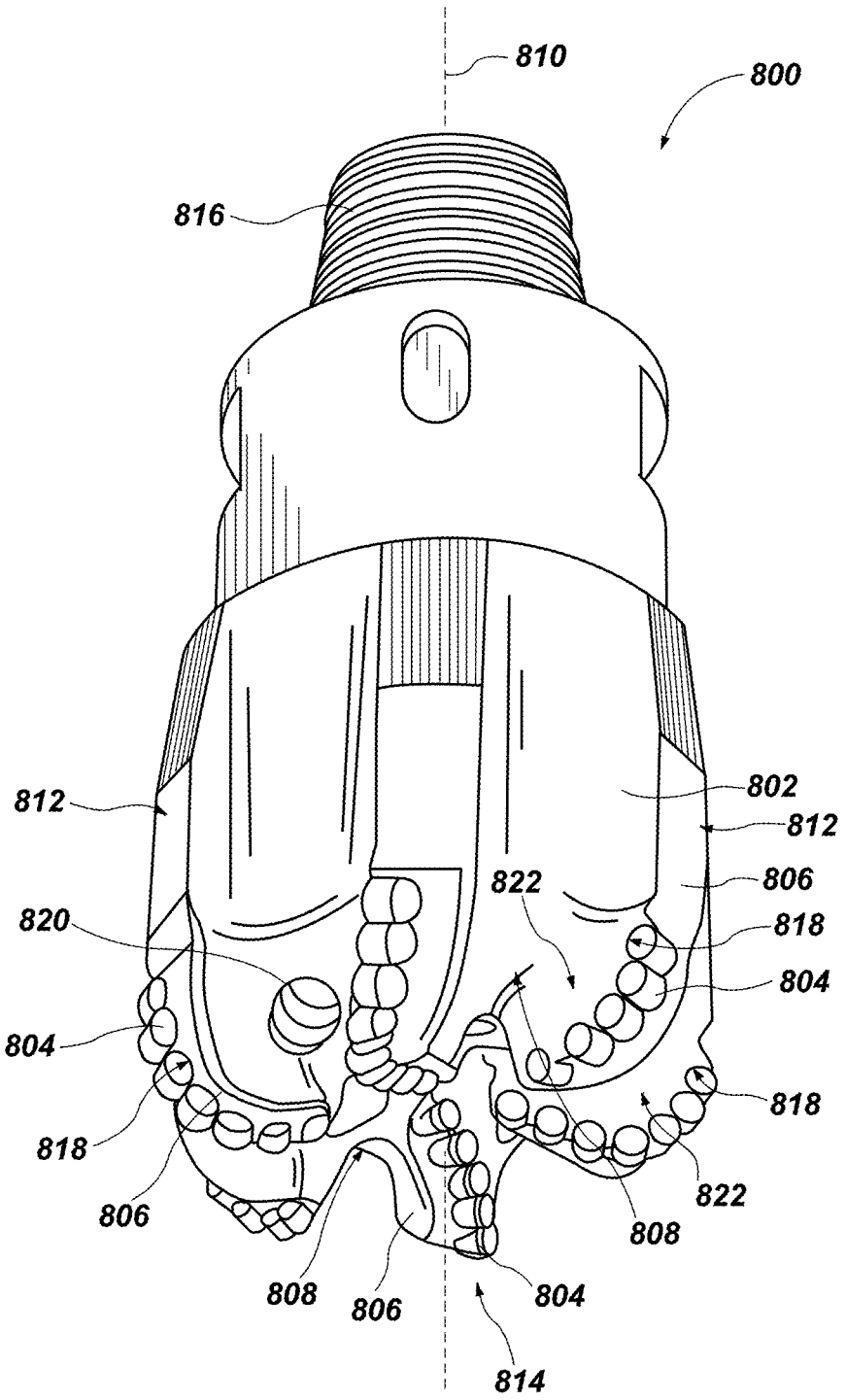
FIG. 8 is a perspective side view of an earth-boring tool including one or more cutting elements in accordance with this disclosure.

FIG. 8 is a perspective side view of an earth-boring tool 800 including one or more cutting elements in accordance with this disclosure. The earth-boring tool 800 may include a body 802 having cutting element 804 secured to the body 802. The earth-boring tool 800 shown in FIG. 8 may be configured as a fixed-cutter drill bit, but other earth-boring tools having cutting elements 804 secured to a body may be employed, such as, for example, those discussed previously in connection with the term "earth-boring tool." The earth-boring tool 800 may include blades 806 extending outward from a remainder of the body 802, with junk slots 808 being located rotationally between adjacent blades 806. The blades 806 may extend radially from proximate an axis of rotation 810 of the earth-boring tool 800 to a gage region 812 at a periphery of the earth-boring tool 800. The blades 806 may extend longitudinally from a face 814 at a leading end of the earth-boring tool 800 to the gage region 812 at the periphery of the earth-boring tool 800. The earth-boring tool 800 may include a shank 816 at a trailing end of the earth-boring tool 800 longitudinally opposite the face 814. The shank 816 may have a threaded connection portion, which may conform to industry standards (e.g., those promulgated by the American Petroleum Institute (API)), for attaching the earth-boring tool 800 to a drill string.

The cutting element 804 may be secured within pockets 818 formed in the blades 806. Nozzles 820 located in the junk slots 808 may direct drilling fluid circulating through the drill string toward the cutting elements 804 to cool the cutting elements 804 and remove cuttings of earth material. The cutting elements 804 may be positioned to contact, and remove, an underlying earth formation in response to rotation of the earth-boring tool 800 when weight is applied to the earth-boring tool 800. One or more of the cutting elements 804 secured to the earth-boring tool 800 may include stress mitigation geometries, as described throughout this disclosure. For example, cutting elements 804 in accordance with this disclosure may be primary or secondary cutting elements (i.e., may be the first or second surface to contact an underlying earth formation in a given cutting path), and may be located proximate a rotationally leading surface 822 of a respective blade 806 or may be secured to the respective blade 806 in a position rotationally trailing the rotationally leading surface 822.

When securing and orienting a given cutting element 804 in accordance with this disclosure within its associated pocket 818, a first portion 122 (see FIG. 1) of the cutting element 804 having a first radius of curvature 124 (see FIG. 1) may be positioned to directly contact and remove an earth formation during use. A second portion 126 (see FIG. 1) of the cutting element 804 having a second, larger radius of curvature 128 (see FIG. 1) may be, for example, positioned not to make direct contact with the earth formation during use. In some embodiments, the second portion 126 (see FIG. 1) may be offset from a cutting point 202 (see FIG. 1) of the cutting edge 108 (see FIG. 1) by at least about 15 degrees (e.g., between about 15 degrees and about 90 degrees). The cutting point 202 (see FIG. 1) may be positioned and oriented for deepest penetration into the earth formation during use. More specifically, the second portion 126 (see FIG. 1) may extend from a first location on the cutting edge 108 (see FIG. 1) at or above a minimum predetermined depth of cut for the cutting element 804 to a second, different location on the cutting edge 108 (see FIG. 1) at or above a maximum predetermined depth of cut for the cutting element 804.

Cutting elements having stress mitigation features in accordance with this disclosure may reduce the risk of crack initiation, crack propagation, and spalling when compared to conventional geometries for cutting elements. For example, the sharpness of first portions of the cutting edge in locations where direct contact is made with an earth formation may facilitate aggressive, efficient removal of material of the earth formation. The comparative roundness of second portions of the cutting edge in locations circumferentially offset from the first portions may reduce stress concentrations. Positioning the second portions to contain anticipated locations for local maxima in stress induced in the cutting edge during drilling may be of particular advantage for reducing crack initiation, crack propagation, and spalling.

Additional, illustrative embodiments within the scope of this disclosure include, but are not limited to, the following:

Embodiment 1: A cutting element for an earth-boring tool, comprising: a cutting edge located proximate to a periphery of the cutting element, the cutting edge positioned and configured to contact an earth formation during an earth-boring operation; wherein the cutting edge comprises a first portion having a first radius of curvature and a second portion having a second, larger radius of curvature, the second portion circumferentially offset from the first portion.

Embodiment 2: The cutting element of Embodiment 1, wherein the first portion extends circumferentially for between about 30 degrees and about 88 degrees.

Embodiment 3: The cutting element of Embodiment 1 or Embodiment 2, wherein the second portion extends circumferentially for between about 1 degree and about 75 degrees.

Embodiment 4: The cutting element of any one of Embodiments 1 through 3, wherein the cutting edge defines at least two instances of the first portion and at least two instances of the second portion, and wherein an entirety of a circumference of the cutting edge is occupied by the instances of the first portion and the instances of the second portion.

Embodiment 5: The cutting element of any one of Embodiments 1 through 4, wherein the first radius of curvature is between about 0.002 inch and about 0.009 inch.

Embodiment 6: The cutting element of any one of Embodiments 1 through 5, wherein the second, larger radius of curvature is between about 0.01 inch and about 0.15 inch.

Embodiment 7: The cutting element of any one of Embodiments 1 through 6, wherein the cutting element comprises a first chamfer surface extending from the cutting edge away from a cutting face of the cutting element and a second chamfer surface extending from the first chamfer surface to the periphery of the cutting element, a transition edge between the first chamfer surface and the second chamfer surface having a third radius of curvature greater than the first radius of curvature.

Embodiment 8: The cutting element of Embodiment 7, wherein the third radius of curvature is at least substantially continuous around a perimeter of the transition edge.

Embodiment 9: The cutting element of any one of Embodiments 1 through 8, wherein the cutting edge comprises at least two instances of the first portion and at least two instances of the second portion, with the first portions and the second portions being rotationally symmetrical about a central geometric axis of the cutting element.

Embodiment 10: The cutting element of any one of Embodiments 1 through 9, wherein the cutting edge comprises between two and four instances of the first portion and between two and four instances of the second portion.

Embodiment 11: An earth-boring tool, comprising: cutting elements affixed to a body, at least one of the cutting elements comprising: a polycrystalline, superabrasive material secured to an end of a substrate, the polycrystalline, superabrasive material comprising a cutting edge located proximate to a periphery of the polycrystalline, suprabrasive material, the cutting edge located distal from the substrate; wherein the cutting edge comprises a first portion having a first radius of curvature and a second portion having a second, larger radius of curvature, the first portion positioned to directly contact and remove an earth formation during use, the second portion positioned not to make direct contact with the earth formation during use.

Embodiment 12: The earth-boring tool of Embodiment 11, wherein the second portion is offset from a cutting point of the cutting edge by at least about 15 degrees, the cutting point positioned for deepest penetration into the earth formation during use.

Embodiment 13: The earth-boring tool of Embodiment 12, wherein the second portion is offset from the cutting point by between about 15 degrees and about 90 degrees.

Embodiment 14: The earth-boring tool of Embodiment 12 or Embodiment 13, wherein the second portion extends from a first location on the cutting edge at or above a minimum predetermined depth of cut for the cutting element to a second, different location on the cutting edge at or above a maximum predetermined depth of cut for the cutting element.

Embodiment 15: The earth-boring of any one of Embodiments 11 through 14, wherein the second portion extends across a position on the cutting edge where a local maximum of stress is located when the cutting element engages with an earth formation at a predetermined depth of cut.

Embodiment 16: The earth-boring of any one of Embodiments 11 through 15, wherein the second portion extends circumferentially for between about 1 degree and about 75 degrees.

Embodiment 17: The earth-boring of any one of Embodiments 11 through 16, wherein the second, larger radius of curvature is between about 0.01 inch and about 0.15 inch.

Embodiment 18: A method of making a cutting element for an earth-boring tool, comprising: forming a first portion of a cutting edge of the cutting element to have a first radius of curvature, the cutting edge located proximate to a periphery of the cutting element, the cutting edge positioned and configured to contact an earth formation during an earth-boring operation; and forming a second portion of the cutting edge to have a second, larger radius of curvature, the second portion circumferentially offset from the first portion.

Embodiment 19: The method of Embodiment 18, wherein forming the second portion of the cutting edge comprises removing a quantity of a material of the cutting element to form the second portion.

Embodiment 20: The method of Embodiment 19, wherein removing the quantity of the material of the cutting element comprises grinding, honing, or laser machining the material of the cutting element.

Embodiment 21: The method of any one of Embodiments 18 through 20, wherein forming the second portion comprises forming the second portion to extend circumferentially for between about 1 degree and about 75 degrees.

Embodiment 22: The method of any one of Embodiments 18 through 21, further comprising: simulating an earth-boring process utilizing a simulated version of the cutting element; determining a position on a simulated cutting edge of the simulated version of the cutting element where a local maximum of stress is located in response to simulating the earth-boring process; selecting a first position and a first angular distance on the cutting edge to be occupied by the first portion in response to determining the position on the simulated cutting edge where the local maximum of stress is located; and selecting a second, different position and a second angular distance on the cutting edge to be occupied by the second portion in response to determining the position on the simulated cutting edge where the local maximum of stress is located.

While certain illustrative embodiments have been described in connection with the figures, those of ordinary skill in the art will recognize and appreciate that the scope of this disclosure is not limited to those embodiments explicitly shown and described in this disclosure. Rather, many additions, deletions, and modifications to the embodiments described in this disclosure may be made to produce embodiments within the scope of this disclosure, such as those specifically claimed, including legal equivalents. In addition, features from one disclosed embodiment may be combined with features of another disclosed embodiment while still being within the scope of this disclosure.

What is claimed is:

1. A cutting element for an earth-boring tool, comprising:

a cutting edge located proximate to a periphery of the cutting element, the cutting edge positioned and configured to contact an earth formation during an earth-boring operation;

wherein the cutting edge comprises a first portion having a first radius of curvature and a second portion having a second, larger radius of curvature, the second portion circumferentially offset from the first portion; and a first chamfer surface extending from the cutting edge away from a cutting face of the cutting element and a second chamfer surface extending from the first chamfer surface to the periphery of the cutting element, a transition edge between the first chamfer surface and the second chamfer surface having a third radius of curvature greater than the first radius of curvature;

wherein, in a cross-sectional side view, each of the first radius of curvature, the second radius of curvature, and the third radius of curvature is about a respective axis extending perpendicular to the cross-sectional side view.

2. The cutting element of claim 1, wherein the first portion extends circumferentially for between 30 degrees and 88 degrees.

3. The cutting element of claim 1, wherein the second portion extends circumferentially for between 1 degree and 75 degrees.

4. The cutting element of claim 1, wherein the cutting edge defines at least two instances of the first portion and at least two instances of the second portion, and wherein an entirety of a circumference of the cutting edge is occupied by the instances of the first portion and the instances of the second portion.

5. The cutting element of claim 1, wherein the first radius of curvature is between 0.002 inch and 0.009 inch.

6. The cutting element of claim 1, wherein the second, larger radius of curvature is between 0.01 inch and 0.15 inch.

7. The cutting element of claim 1, wherein the third radius of curvature is continuous around a perimeter of the transition edge.

8. The cutting element of claim 1, wherein the cutting edge defines at least two instances of the first portion and at least two instances of the second portion, with the first portions and the second portions being rotationally symmetrical about a central geometric axis of the cutting element.

9. The cutting element of claim 1, wherein the cutting edge comprises between two and four instances of the first portion and between two and four instances of the second portion.

10. An earth-boring tool, comprising:

a tool body; and cutting elements affixed to the tool body, at least one of the cutting elements comprising:

a polycrystalline, superabrasive material secured to an end of a substrate, the polycrystalline, superabrasive material comprising a cutting edge located proximate to a periphery of the polycrystalline, superabrasive material, the cutting edge located distal from the substrate;

wherein the cutting edge comprises a first portion having a first radius of curvature and a second portion having a second, larger radius of curvature, the first portion positioned to directly contact and remove an earth formation during use, the second portion positioned not to make direct contact with the earth formation during use; and a first chamfer surface extending from the cutting edge away from a cutting face of the cutting element and a second chamfer surface extending from the first chamfer surface to the periphery of the cutting element, a transition edge between the first chamfer surface and the second chamfer surface having a third radius of curvature greater than the first radius of curvature;

wherein, in a cross-sectional side view, each of the first radius of curvature, the second radius of curvature, and the third radius of curvature is about a respective axis extending perpendicular to the cross-sectional side view.

11. The earth-boring tool of claim 10, wherein the second portion is offset from a cutting point of the cutting edge by at least 15 degrees, the cutting point positioned for deepest penetration into the earth formation during use.

12. The earth-boring tool of claim 11, wherein the second portion is offset from the cutting point by between 15 degrees and 90 degrees.

13. The earth-boring tool of claim 11, wherein the second portion extends from a first location on the cutting edge at or above a minimum predetermined depth of cut for the cutting element to a second, different location on the cutting edge at or above a maximum predetermined depth of cut for the cutting element.

14. The earth-boring of claim 10, wherein the second portion extends across a position on the cutting edge where a local maximum of stress is located when the cutting element engages with an earth formation at a predetermined depth of cut.

15. A method of making a cutting element for an earth-boring tool, comprising:

forming a first portion of a cutting edge of the cutting element to have a first radius of curvature, the cutting edge located proximate to a periphery of the cutting element, the cutting edge positioned and configured to contact an earth formation during an earth-boring operation;

forming a second portion of the cutting edge to have a second, larger radius of curvature, the second portion circumferentially offset from the first portion; and forming a first chamfer surface extending from the cutting edge away from a cutting face of the cutting element and a second chamfer surface extending from the first chamfer surface to the periphery of the cutting element, such that a transition edge between the first chamfer surface and the second chamfer surface has a third radius of curvature greater than the first radius of curvature;

wherein, in a cross-sectional side view, each of the first radius of curvature, the second radius of curvature, and the third radius of curvature is about a respective axis extending perpendicular to the cross-sectional side view.

16. The method of claim 15, wherein forming the second portion of the cutting edge comprises removing a quantity of a material of the cutting element to form the second portion.

17. The method of claim 16, wherein removing the quantity of the material of the cutting element comprises grinding, honing, or laser machining the material of the cutting element.

18. The method of claim 15, wherein forming the second portion comprises forming the second portion to extend circumferentially for between 1 degree and 75 degrees.

19. The method of claim 15, further comprising:

simulating an earth-boring process utilizing a simulated version of the cutting element;

determining a position on a simulated cutting edge of the simulated version of the cutting element where a local maximum of stress is located in response to simulating the earth-boring process;

selecting a first position and a first angular distance on the cutting edge to be occupied by the first portion in response to determining the position on the simulated cutting edge where the local maximum of stress is located; and selecting a second, different position and a second angular distance on the cutting edge to be occupied by the second portion in response to determining the position on the simulated cutting edge where the local maximum of stress is located.

* * * * *